US007337628B2

(12) United States Patent
Okuda et al.

(10) Patent No.: US 7,337,628 B2
(45) Date of Patent: Mar. 4, 2008

(54) LOW-TEMPERATURE STORAGE

(75) Inventors: Satoshi Okuda, Ota (JP); Yasuhide Watanabe, Osato-gun (JP); Yasushi Sakata, Tatebayashi (JP)

(73) Assignees: Sanyo Electric Co., Ltd., Moriguchi-shi (JP); Sanyo Electric Biomedical Co., Ltd., Moriguchi-shi (JP)

( * ) Notice: Subject to any disclaimer, the term of this patent is extended or adjusted under 35 U.S.C. 154(b) by 291 days.

(21) Appl. No.: 10/963,774

(22) Filed: Oct. 14, 2004

(65) Prior Publication Data

US 2005/0138955 A1 Jun. 30, 2005

(30) Foreign Application Priority Data

Oct. 21, 2003 (JP) ..... 2003-361310
Apr. 21, 2004 (JP) ..... 2004-125163

(51) Int. Cl.
*F25D 11/02* (2006.01)

(52) U.S. Cl. ..... 62/441; 62/447

(58) Field of Classification Search ..... 62/441, 62/447, 440, 442, 443, 444, 492.1; 312/401, 312/408, 405, 407, 296; 49/368, 490.1
See application file for complete search history.

(56) References Cited

U.S. PATENT DOCUMENTS 2,745,259 A * 5/1956 Saunders ..... 62/266
5,046,770 A * 9/1991 Hansen ..... 292/218
5,154,502 A * 10/1992 Takaoka ..... 312/407
5,349,832 A * 9/1994 Johnson et al. ..... 62/447
5,737,939 A * 4/1998 Valence et al. ..... 62/441
6,851,776 B2 * 2/2005 Bienick ..... 312/408

FOREIGN PATENT DOCUMENTS

JP 2001-82863 A * 3/2001

* cited by examiner

*Primary Examiner*—Mohammad M. Ali
(74) *Attorney, Agent, or Firm*—Kratz, Quintos & Hanson, LLP

(57) ABSTRACT

An object is to provide a low-temperature storage capable of further dividing a medium storage chamber divided by a medium partition into upper/lower small sections (small storage chambers) by adding of an optional component and changing of an inner door, and the storage comprising; a thermal insulation box main body having an opening in a front surface thereof; a thermal insulating door openably/closably attached to the thermal insulation box main body; a medium partition which divides the opening into upper/lower medium openings; a shelf which divides a storage chamber formed by the thermal insulating door and the main body into upper/lower chambers in a position of the medium partition; a cooling device which cools the storage chamber; a metallic optional partition member which further divides the medium openings into upper/lower openings; a frame member formed of a resin and attached to a front part of the partition member to support an optional gasket; and a plurality of inner doors which openably close small openings divided by the partition member.

12 Claims, 12 Drawing Sheets

PRESENT INVENTION
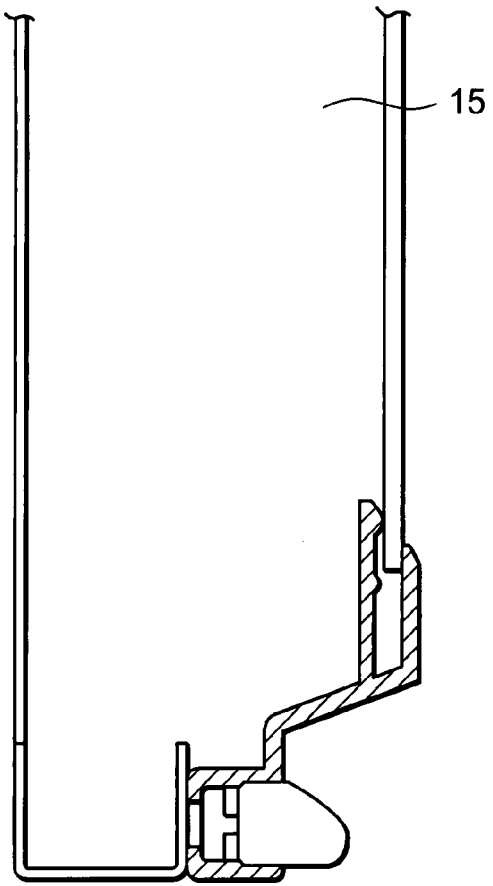
CONVENTIONAL
FIG. 7A

LOW-TEMPERATURE STORAGE

BACKGROUND OF THE INVENTION

The present invention relates to a low-temperature storage including a storage chamber cooled/maintained in an ultra low temperature range around −80° C. by a cooling device comprising a binary refrigeration circuit which realizes a lower storage temperature by cascade connection of an evaporator in a refrigeration circuit on a high-temperature side to a condenser in a refrigeration circuit on a low-temperature side. The present invention relates particularly to a partition for dividing a front surface opening of an insulation box into upper/lower openings, a partition member for dividing a frontage into upper/lower frontages, and a latch structure of inner doors, capable of selecting two or four inner doors in accordance with the partition member.

Among low-temperature storages, there is a shed in which a binary refrigeration circuit is used in order to produce an ultra low temperature range of about −60° C. to −90° C. and which is constituted by cascade connection of an evaporator of a refrigeration circuit on a high-temperature side to a condenser of a refrigeration circuit on a low-temperature side. This low-temperature storage is sometimes referred to as an ultra low temperature freezer by its temperature band. To more efficiently store a storage object, the inside of a storage chamber is divided into upper/lower chambers by a plurality of shelves. When the storage chamber divided into a plurality of chambers is opened/closed with one door, outside air entirely enters the storage chamber with the opening/closing of the door. Therefore, the outside air also enters a medium storage chamber corresponding to the shelf unrelated to an object to be discharged/charged. To avoid this, a plurality of inner doors have been disposed corresponding to the medium storage chamber. In this case, the front surface opening of the insulation box is divided into two upper/lower openings by a partition, and upper/lower inner doors are disposed. This medium storage chamber is sometimes further divided into upper/lower small storage chambers by the shelf.

For example, as described in Japanese Patent Application Laid-Open No. 6-129760, there is a refrigerator whose storage chamber is divided by a partition portion and in which a partition front frame is also disposed in a front surface portion of the partition portion and in which a space formed by the partition front frame and the partition portion is filled with a foamed insulating material. The storage chamber divided into upper/lower chambers by the partition portion is usually openably closed by insulating doors. A gasket provided with a magnet is disposed on an inner surface peripheral edge portion of each door, and this gasket adheres to a metal cover disposed for an opening edge of the insulation box and the front surface of the partition front frame to prevent permeation of the outside air into each storage chamber. For example, as described in Japanese Patent Application Laid-Open No. 2001-183052, there is a cold storage in which the front surface opening of the storage chamber is openably closed with one thermal insulating door, and a plurality of resin upper/lower inner doors are openably/closably disposed inside the thermal insulating door. Especially the inner door mechanically closes the opening by a latch mechanism.

In the household refrigerator described in the former document, the medium storage chamber divided by the partition is not further divided into upper/lower small sections (small storage chambers) by addition of an optional component or change of the inner door. In a low-temperature storage such as a business refrigerator, an inner volume is usually enlarged as compared with the household storage. Therefore, the optional component can be preferably added at any time in accordance with user's (so-called customer) demand. In the cold storage described in the latter document, a detailed structure of the latch mechanism is unknown. Judging from the drawing, the thermal insulating inner door is forcibly pushed into the storage chamber using a principle of leverage by rotation/operation of the latch mechanism, and the opening is firmly and securely closed by the inner door. However, in the ultra low-temperature storage for use in an ultra low temperature range of about −60° C. to −90° C., the outside air which has entered by the opening/closing of the inner door is rapidly cooled. Therefore, a frosting phenomenon easily becomes remarkable in the vicinity of an outlet/inlet, particularly into an in-shed wall surface of the inner door provided with the latch mechanism on a non-shaft support side. Since thickness and hardness of frost gradually grow by long-term storage in the frosting phenomenon, the grown frost hinders a latch operation of the latch mechanism. That is, in the beginning of the frosting phenomenon, the inner door can be pushed inwards even slightly forcibly by the principle of leverage, but it is also expected that the thickness grows to such an extent that the inner door cannot be closed during long-term use. In this case, the latch mechanism is operated with a considerably strong force, and there has been a disadvantage that a part (especially a portion lacking in strength) of the latch mechanism is deformed by a function of a stress which is not less than a strength (withstand load) in the latch mechanism, and the mechanism does not normally operated thereafter.

SUMMARY OF THE INVENTION

An object of the present invention is to provide a low-temperature storage capable of adding and removing optional components and accordingly changing an inner door to thereby further divide a medium storage chamber divided by a partition into small upper/lower sections (small storage chambers). Additionally, another object of the present invention is to provide a low-temperature storage capable of raising a strength of an engagement portion in a latch mechanism and enlarging a usable range against a gradually growing frosting situation.

A low-temperature storage (1) of the present invention comprises: a thermal insulation box main body (2) having an opening (2A) in a front surface thereof; a thermal insulating door (4) openably/closably attached to the thermal insulation box main body; a medium partition (16) which divides the opening into upper/lower medium openings (12); a shelf (11) which divides a storage chamber formed by the thermal insulating door and the main body into upper/lower chambers in a position of the medium partition; and a cooling device which cools the storage chamber (5), the low-temperature storage further comprising: a metallic optional partition member (17) which further divides the medium openings (12) into upper/lower openings; a frame member (31) formed of a resin and attached to a front part of the partition member (17) to support an optional gasket (35); and a plurality of inner doors (15) which openably close small openings (14) divided by the partition member (17).

According to the present invention, the medium openings (12) can be divided further into the upper/lower small openings (14) by the optional partition member (17) formed of the metal, the optional gasket (35) can be supported by the frame member (31) formed of the resin and attached to the front part of a main body (21) of the partition member (17), the respective small openings (14) newly divided by optional components like the partition member (17) can be openably closed by a plurality of inner doors (15), and the low-temperature storage can be provided in response to a user's demand.

Moreover, in the low-temperature storage (1) of the present invention, the main body (21) of the optional partition member (17) is constituted of: support metals (22) attached to an inner box side surface front portion of the thermal insulation box main body; and a beam member (23) which is supported by opposite support metals (22, 22) and to which the frame member (31) is attached and whose cross-sectional surface has a U-shape.

According to the present invention, the main body (21) of the optional partition member (17) comprises: the support metals (22, 22) attached to the inner box side surface front portion of the insulation box main body; and the beam member (23) which is supported by the opposite support metals (22, 22) and to which the frame member (31) for supporting the optional gasket (35) is attached and whose cross-sectional surface has the U-shape. Accordingly, strength of the partition member (17) is secured. On the other hand, a height in a vertical direction can be suppressed, and an effective volume of the storage chamber (5) can be secured.

Moreover, in the low-temperature storage (1) of the present invention, the beam member (23) is laid on and fixed to the support metals (22, 22).

According to the present invention, since the beam member (23) of the optional partition member (17) is laid on and fixed to the support metals (22, 22), the optional component can be easily attached, and workability is enhanced.

Furthermore, in the low-temperature storage (1) of the present invention, the optional gasket (35) abuts on a packing (48) disposed on back surface peripheral edge portions of the upper/lower inner doors (15, 15).

According to the present invention, the optional gasket (35) which abuts on the packing (48) disposed on the back surface peripheral edge portions of the upper/lower inner doors (15) absorbs shock at a time when the inner doors (15) are closed, and is capable of satisfactorily sealing the packing.

Additionally, in the low-temperature storage (1) of the present invention, the optional gasket (35) comprises: upper/lower fin pieces (38, 39) which seal the packing (48) above and below a portion abutting on the packing (48).

According to the present invention, the upper/lower fin pieces (38, 39) which are disposed on the optional gasket (35) and which abut on the packing (48) to seal the packing above and below the portion abutting on the packing (48) more securely establish a contact relation between the gasket (35) and the packing (48), and are capable of enhancing sealability.

Moreover, in the low-temperature storage (1) of the present invention, the inner door (15) comprises: a finned packing (49) extending inside the packing (48) and toward the optional gasket (35).

According to the present invention, the finned packing (49) disposed on the inner door (15) and extending inside the packing (48) and toward the optional gasket (35) is capable of forming a space K defined by the packing (48), the gasket (35), and the finned packing (49). Permeation of outside air can be prevented by an air layer in the space K, and a sealing performance is remarkably enhanced.

Furthermore, in the low-temperature storage (1) of the present invention, the inner door (15) is constituted of: an outer plate (41); an inner plate (42); a door frame (43) which thermally insulates both the plates and which is formed of a resin; and an insulating material (44) disposed in a space surrounded with the outer plate, the inner plate, and the door frame, and the door frame (43) is provided with: a first groove (45) to which the packing (48) is attached; and a second groove (46) to which the finned packing (49) is attached.

According to the present invention, the inner door (15) is constituted of: the outer plate (41); the inner plate (42); the door frame (43) which thermally insulates both the plates and which is formed of the resin; and the insulating material (44) disposed in the space surrounded with the outer plate, the inner plate, and the door frame, and therefore the openings of the respective storage chambers can be thermally insulated. Moreover, the door frame (43) is provided with: the first groove (45) to which the packing (48) is attached; and the second groove (46) to which the finned packing (49) is attached. Therefore, double seal can be realized, and insulating performance is further enhanced.

Moreover, according to the present invention, there is provided a low-temperature storage (1) comprising: a thermal insulation box main body (2) having an opening in a front surface; a thermal insulating door (4) openably/closably attached to the thermal insulation box main body; a medium partition (16) which divides the opening into upper/lower medium openings (12); a shelf (11) which divides a storage chamber (5) formed by the thermal insulating door and the main body into upper/lower chambers in a position of the medium partition (16); a cooling device which cools the storage chamber around −80° C.; and a main body (21) of an optional partition member (17) which is formed of a metal and which further divides the medium openings (12) into upper/lower openings and to whose front portion a frame member (31) formed of a resin and supporting an optional gasket (35) is attached, the low-temperature storage further comprising: a plurality of inner doors (15) which are supported by hinges and which openably close small openings (14) divided by the partition member (17); a shaft metal (65) disposed in portions of the respective small openings (14) on a side on which any hinge is not attached in an inner box of the thermal insulation box main body, and having a shaft portion (68) formed of a cast metal; and a metallic latch (50) rotatably disposed on the inner door and having a claw portion (60) engaging with the shaft metal (65).

According to the present invention, the shaft metal (65) is disposed in the respective small opening portions on the side on which any hinge is not attached in the inner box of the insulation box main body, and has the shaft portion (68) formed of the cast metal. The metallic latch (50) is rotatably disposed on the plurality of inner doors (15) which are supported by the hinges and which openably close the respective small openings (14) divided by the optional partition member (17), and has the claw portion (60) engaging with the shaft metal (65).

Accordingly, a rotating force is applied to the latch in a state in which the claw portion (60) is engaged with the shaft portion (68). Then, a latch device of the inner door (15) can be constituted which is capable of forcibly pushing the inner door (15) backwards by a principle of leverage of both the portions.

Moreover, in the low-temperature storage (1) of the present invention, the claw portion (60) has a double structure of a stainless layer (62) and a cast metal layer (63).

According to the present invention, since the claw portion (60) has the double structure of the stainless layer (62) and the cast metal layer (63), the strength is enhanced, and a length and a distance of a thickness direction can be increased.

Furthermore, in the low-temperature storage (1) of the present invention, the shaft portion (68) is formed into a columnar shape, and the latch (50) pushes the inner door (15) in a closing direction with the rotating force at a time when the claw portion (60) is engaged with the shaft portion (68).

According to the present invention, since the shaft portion (68) is formed into the columnar shape, the strength of the portion is enhanced as compared with a plate-shaped cut raised portion (80). The latch (50) can change the rotating force at a time when the claw portion (60) is engaged with the shaft portion (68) of the shaft metal (65) into a force for pushing the inner door (15) in the closing direction using the principle of leverage.

Additionally, in the low-temperature storage (1) of the present invention, a length (T) of the claw portion is set in such a manner that the inner door (15) is pushed in the closing direction by a dimensional difference between a rotation radius (R1) of a tip of an abutment surface of the claw portion (60) with respect to the shaft portion (68), and a rotation radius (R2) of a terminal end.

According to the present invention, the length (T) of the claw portion is set in such a manner that the inner door (15) is pushed in the closing direction by the dimensional difference between the rotation radius (R1) of the tip of the abutment surface of the claw portion (60) with respect to the shaft portion (68), and the rotation radius (R2) of the terminal end. Therefore, a rotary momentum of the latch (50) with respect to the shaft portion (68) can be increased, it is possible to bring the latch (50) into a latched state even with a smaller force, and usability of a latch device (20) is enhanced.

Moreover, according to the present invention, there is provided a low-temperature storage (1) comprising: a thermal insulation box main body (2) having an opening (2A) in a front surface; a single thermal insulating door (4) openably/closably attached to the thermal insulation box main body; a single medium partition (16) which divides the opening into upper/lower medium openings (12); a shelf (11) which divides a storage chamber formed by the thermal insulating door and the main body into upper/lower chambers in a position of the medium partition (16); and a cooling device which cools the storage chamber around −80° C., the low-temperature storage further comprising: two first inner doors (13) which openably close the upper/lower medium openings (12) in a case where a partition member (17) detachably attached to further divide the medium openings (12) into upper/lower small openings (14) is not disposed; or four second inner doors (15) which openably close the four small openings (14) in a case where the partition member (17) is disposed.

According to the present invention, both types can be selected in which the medium openings (12) are further divided into the upper/lower openings by the partition member (17), and are not divided. The first inner doors (13) or the second inner doors (15) can be selected based on whether or not the partition member (17) is selected. A division system can be realized in accordance with user's need with respect to the low-temperature storage, and versatility increases (range of selection increases).

Furthermore, the low-temperature storage (1) of the present invention further comprises: a resin-formed frame member (31) which is attached to the front portion of the partition member (17) to support a gasket (35), and the gasket (35) abuts on a packing (48) disposed on back surface peripheral edge portions of the second inner doors (15), and comprises upper/lower fin pieces (38, 39) to seal the packing above and below a portion which abuts on the packing.

According to the present invention, the gasket (35) which abuts on the packing (48) disposed on the back surface peripheral edge portions of the second inner doors (15) absorbs shock at a time when the second inner doors (15) are closed, and is capable of satisfactorily sealing the packing. The upper/lower fin pieces (38, 39) which are disposed on the gasket (35) and which abut on the packing (48) to seal the packing above and below the portion abutting on the packing more securely establish a contact relation between the gasket (35) and the packing (48), and are capable of enhancing sealability between the second inner doors (15) and the partition member (17).

Furthermore, in the low-temperature storage (1) of the present invention, the second inner door (15) comprises a finned packing (49) extending inside the packing (48) and toward the gasket (35).

According to the present invention, the finned packing (49) disposed on the second inner door (15) and extending inside the packing (48) and toward the optional gasket (35) is capable of forming a space K defined by the packing (48), the gasket (35), and the finned packing (49). Permeation of outside air from the outside of the second inner door (15) can be prevented by an air layer in the space K, and a sealing performance between the second inner door (15) and the partition member (17) is remarkably enhanced.

DETAILED DESCRIPTION OF THE PREFERRED EMBODIMENTS

Figure 1:
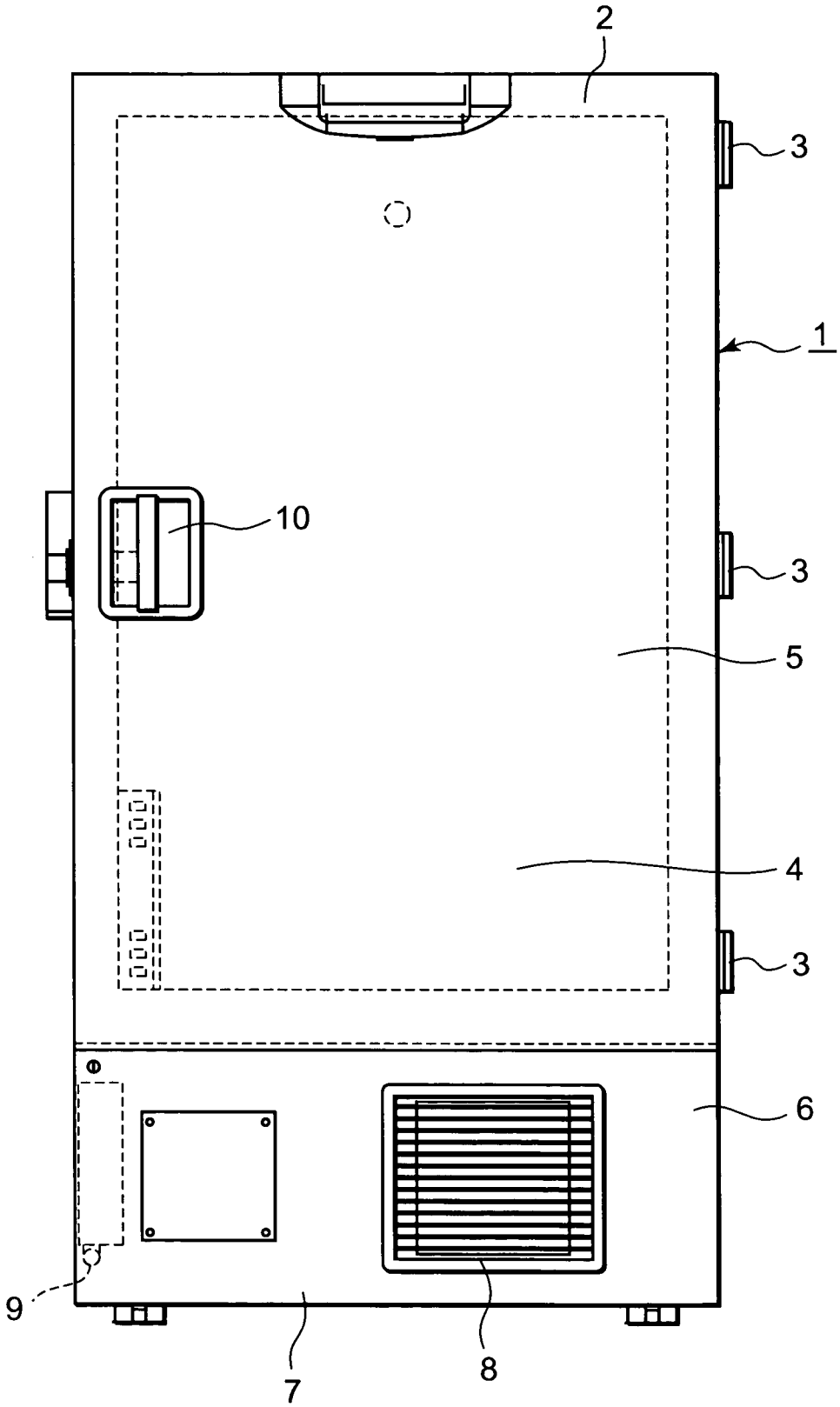
FIG. 1 is a front view of a low-temperature storage according to the present invention.

Embodiments of the present invention will be described hereinafter in detail with reference to the drawings. As shown in FIGS. 1 to 4, a low-temperature storage (ultra low temperature freezer) of the present invention comprises: a thermal insulation box main body 2 having an opening 2A in a front surface; a right-opening type thermal insulating door 4 which is an outer door openably/closably attached to the thermal insulation box main body 2 via a plurality of (three in the present embodiment) hinges 3 to close the opening 2A; a storage chamber 5 formed by the door 4 and the main body 2; a cooling device (not shown) positioned under the storage chamber 5 to cool the storage chamber 5; and a mechanical chamber 6 in which an electrical/mechanical component such as an electrically equipped box 9 is stored. The front surface of the mechanical chamber 6 is openably/closably covered with a front panel 7, and a grille 8 which is a suction port cover with respect to an air guide duct disposed behind the panel, a filter for capturing dust, condenser and the like (not shown) is attached to the front panel 7.

Figure 2:
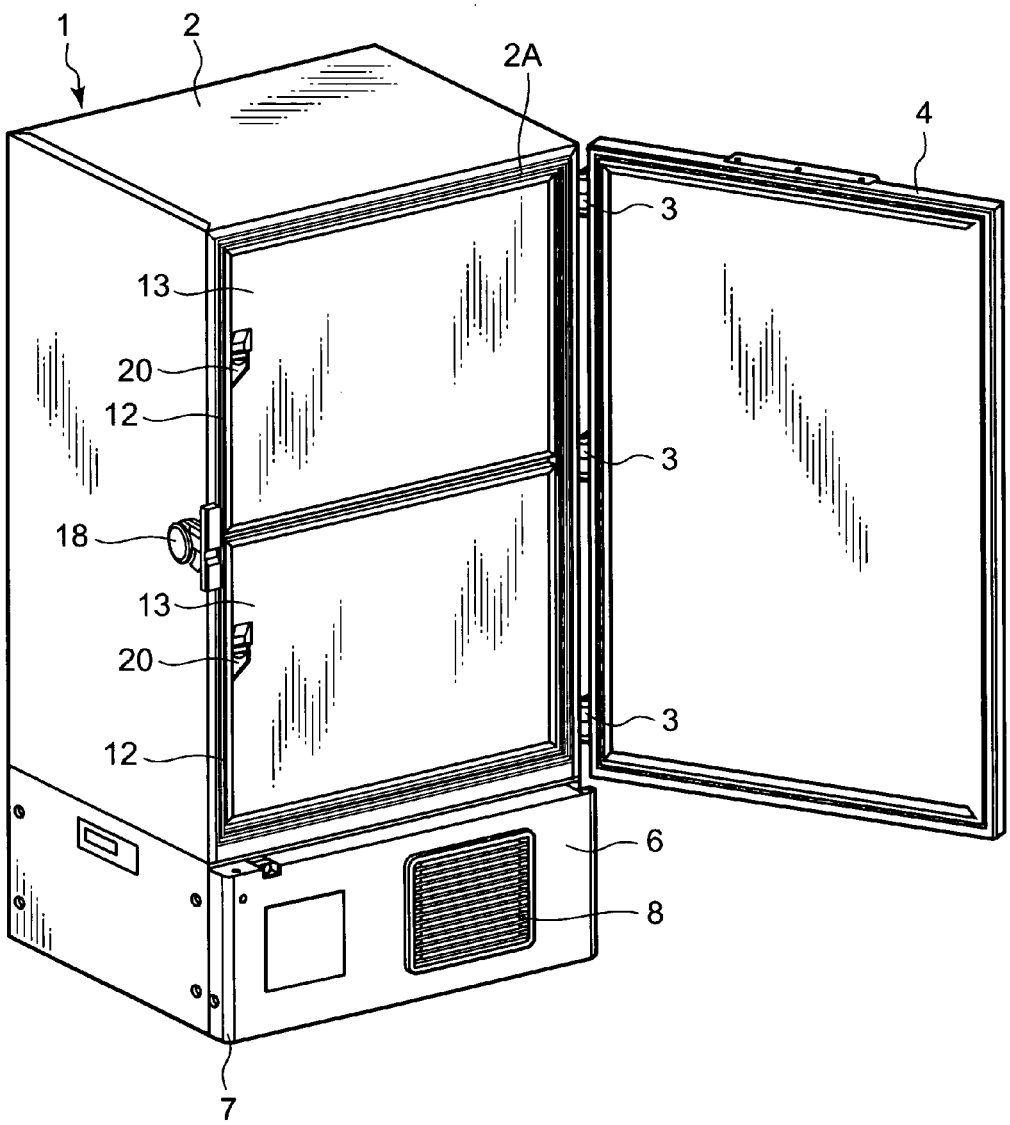
FIG. 2 is a perspective view showing a state in which an outer door (thermal insulating door) of the low-temperature storage of the present invention is opened and two inner doors (first inner doors) are closed.
Figure 3:
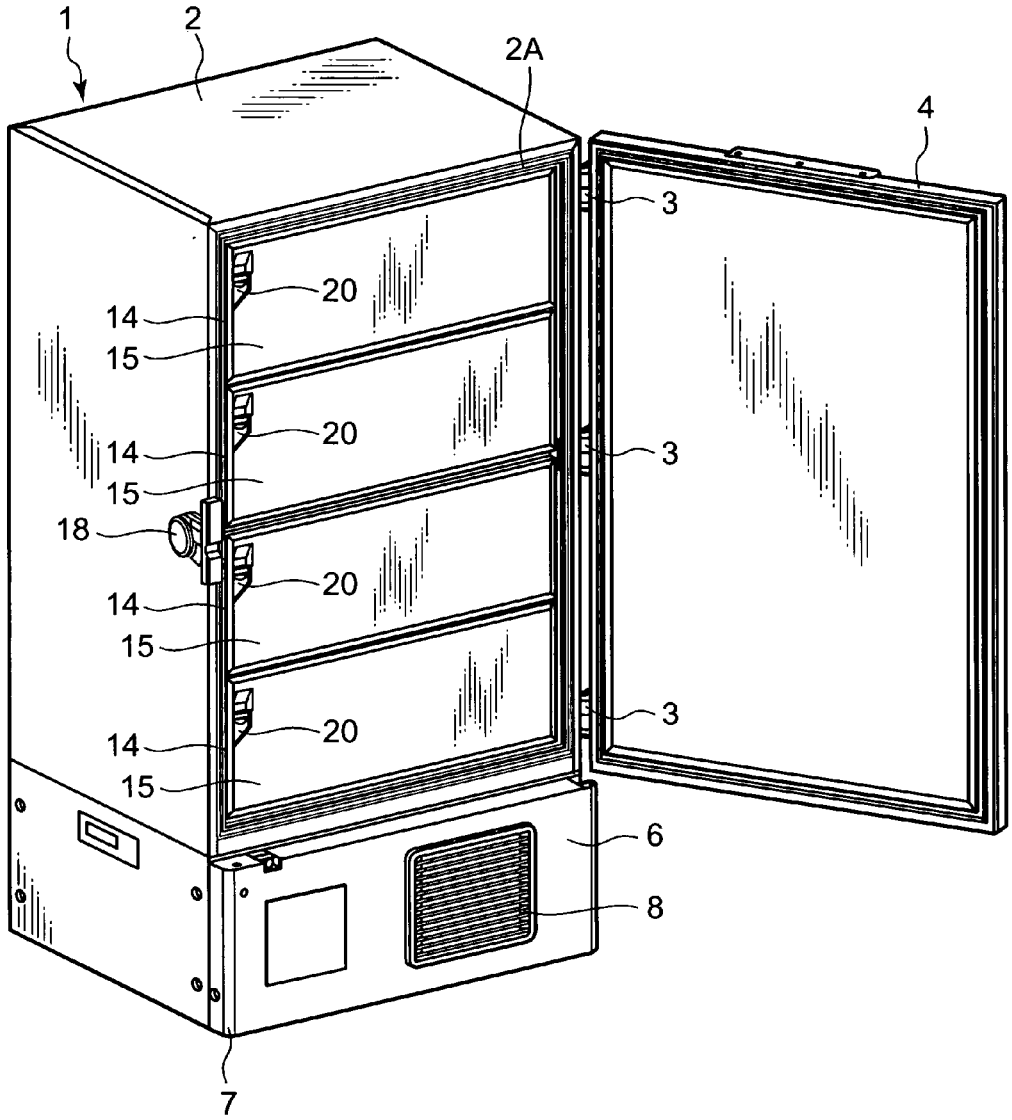
FIG. 3 is a perspective view showing a state in which the outer door (thermal insulating door) of the low-temperature storage of the present invention is opened and four inner doors (second inner doors) are closed.
Figure 4:
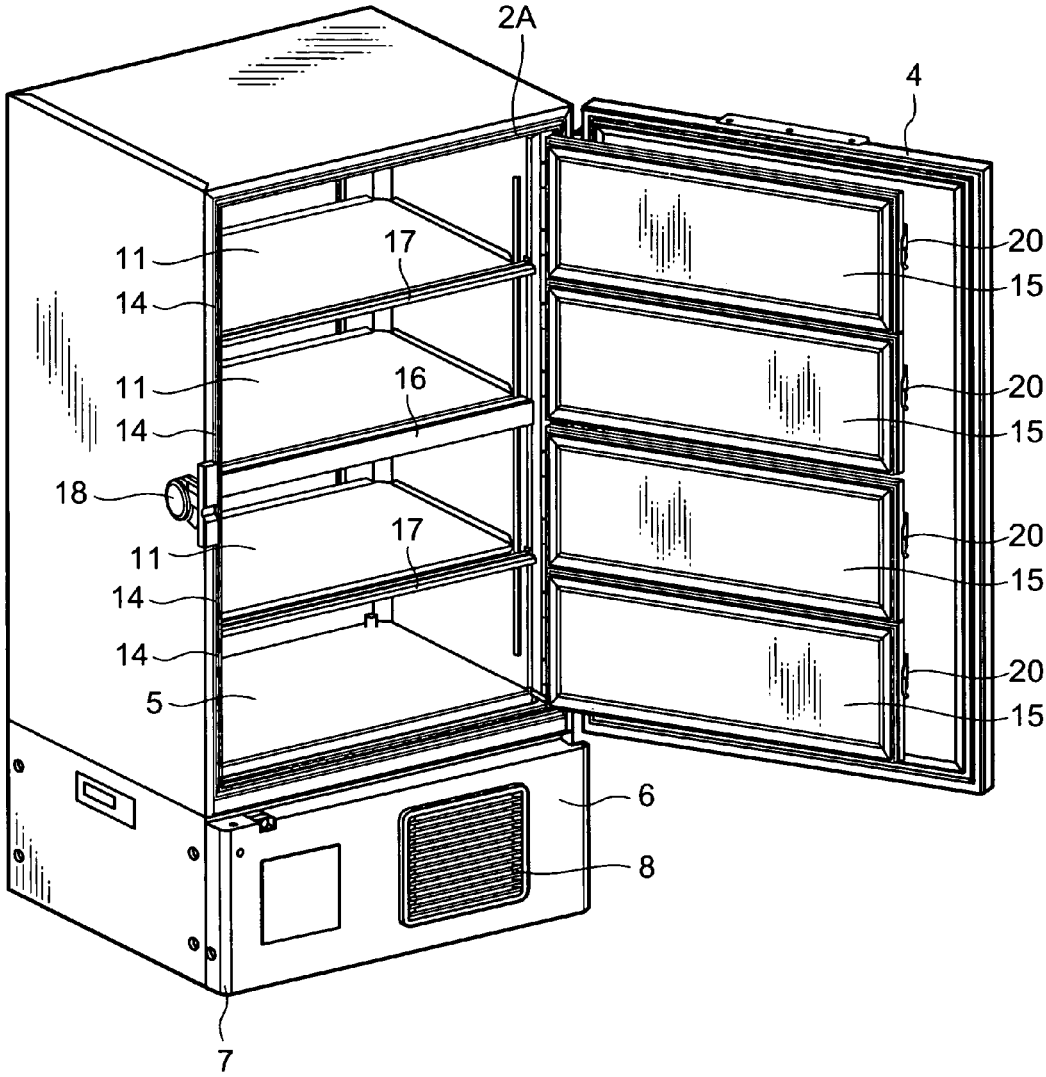
FIG. 4 is a perspective view showing a state in which the outer door (thermal insulating door) of the low-temperature storage of the present invention, and four inner doors (second inner doors) are opened.
Figure 5:
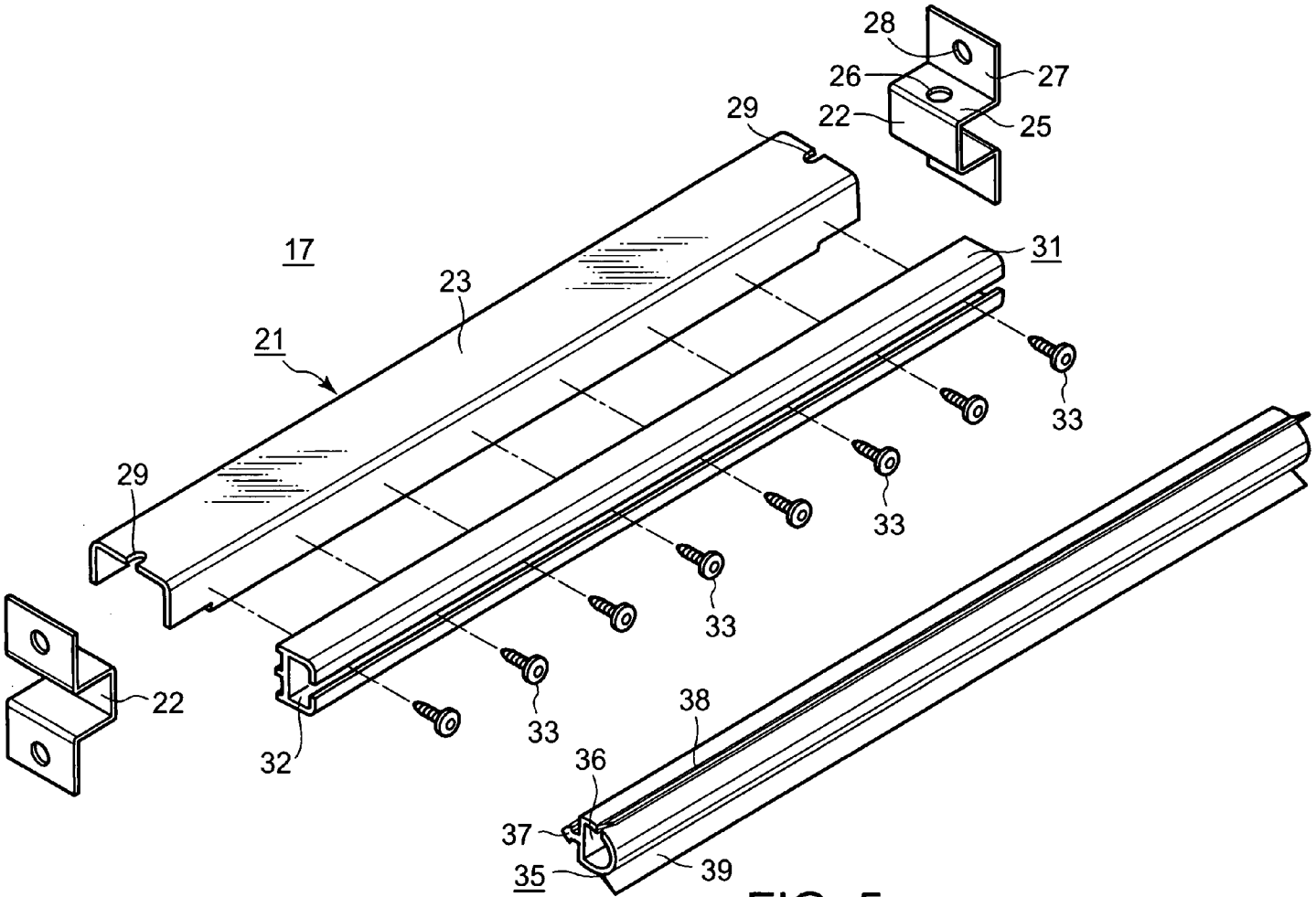
FIG. 5 is an exploded perspective view of an optional partition member, a front frame, and an optional gasket showing a first embodiment of the present invention.
Figure 6:
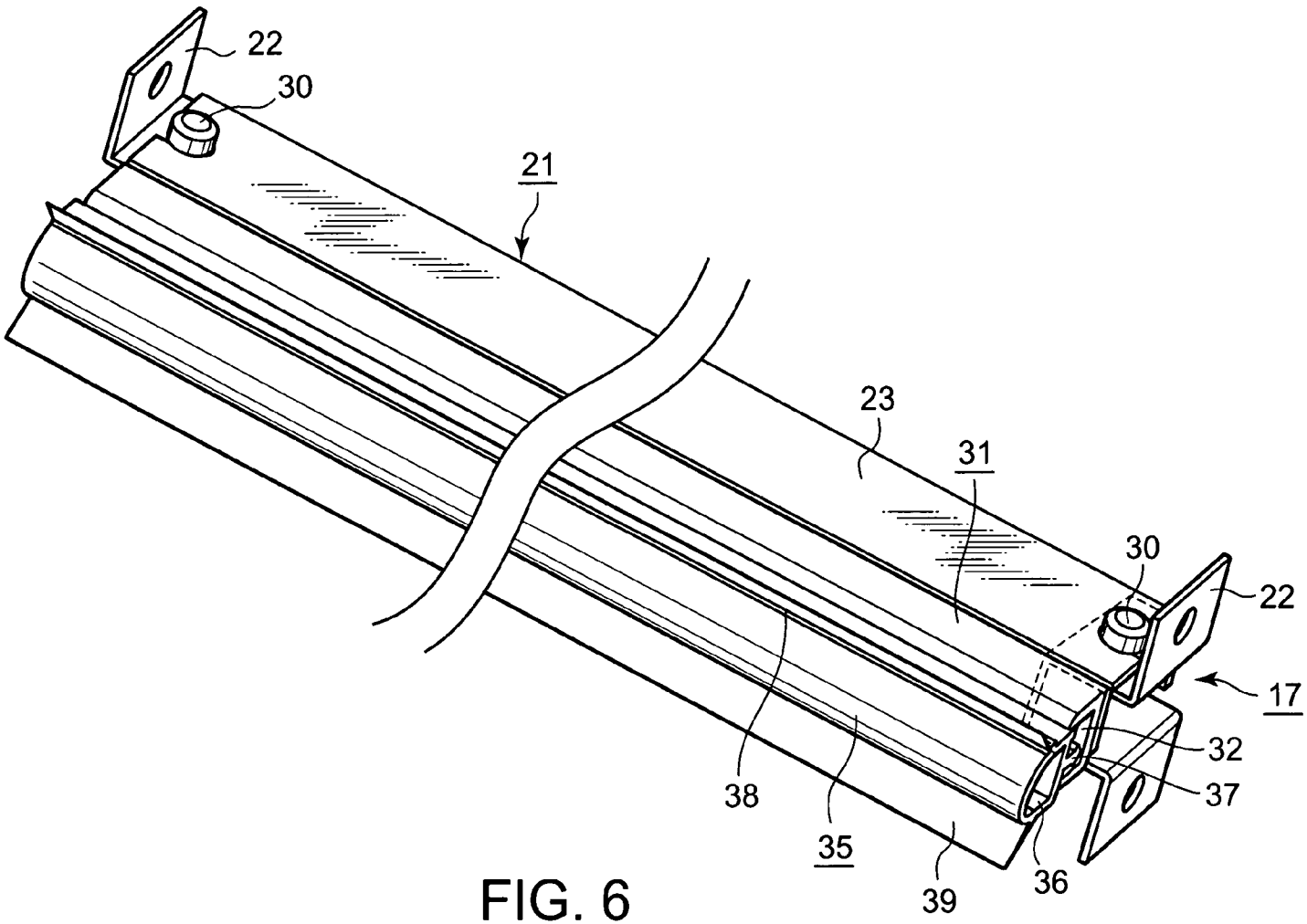
FIG. 6 is a perspective view showing an assembled state of the optional partition member, front frame, and optional gasket according to the present invention.
Figure 7B:
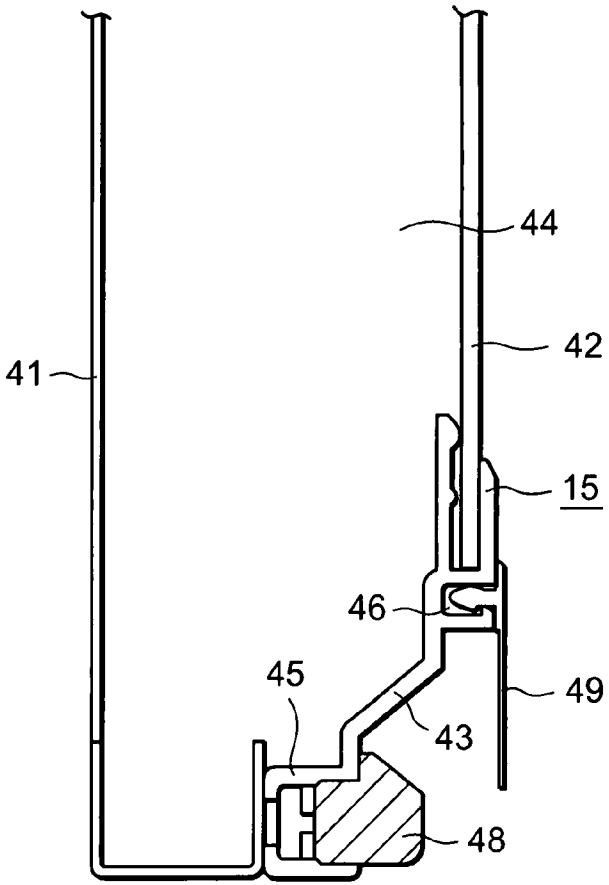
FIG. 7 is a sectional view showing comparison of a conventional inner door frame with an inner door frame of the present invention.
Figure 8:
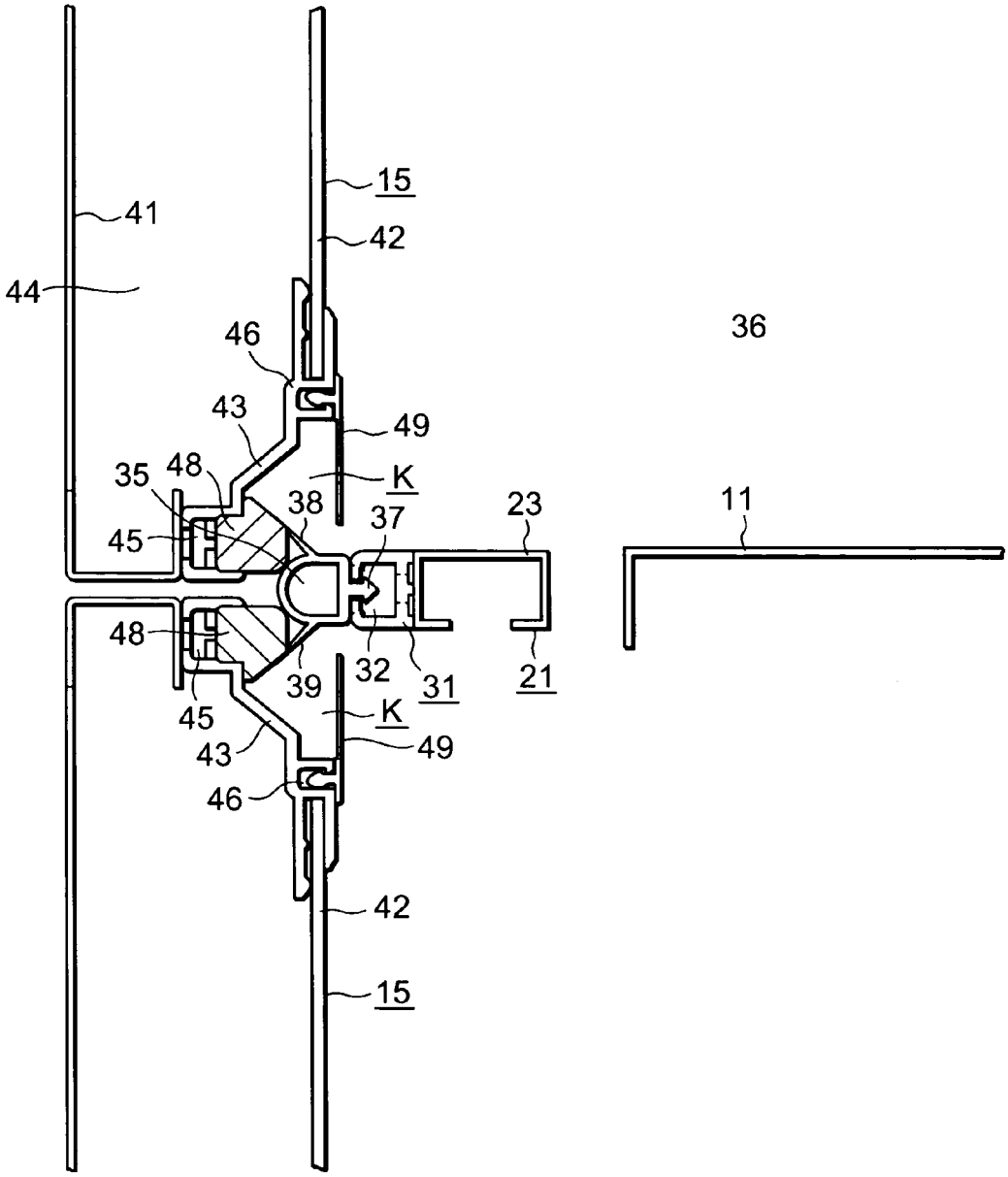
FIG. 8 is a sectional view showing a relation between the inner door and an optional component in the present invention.
Figure 9:
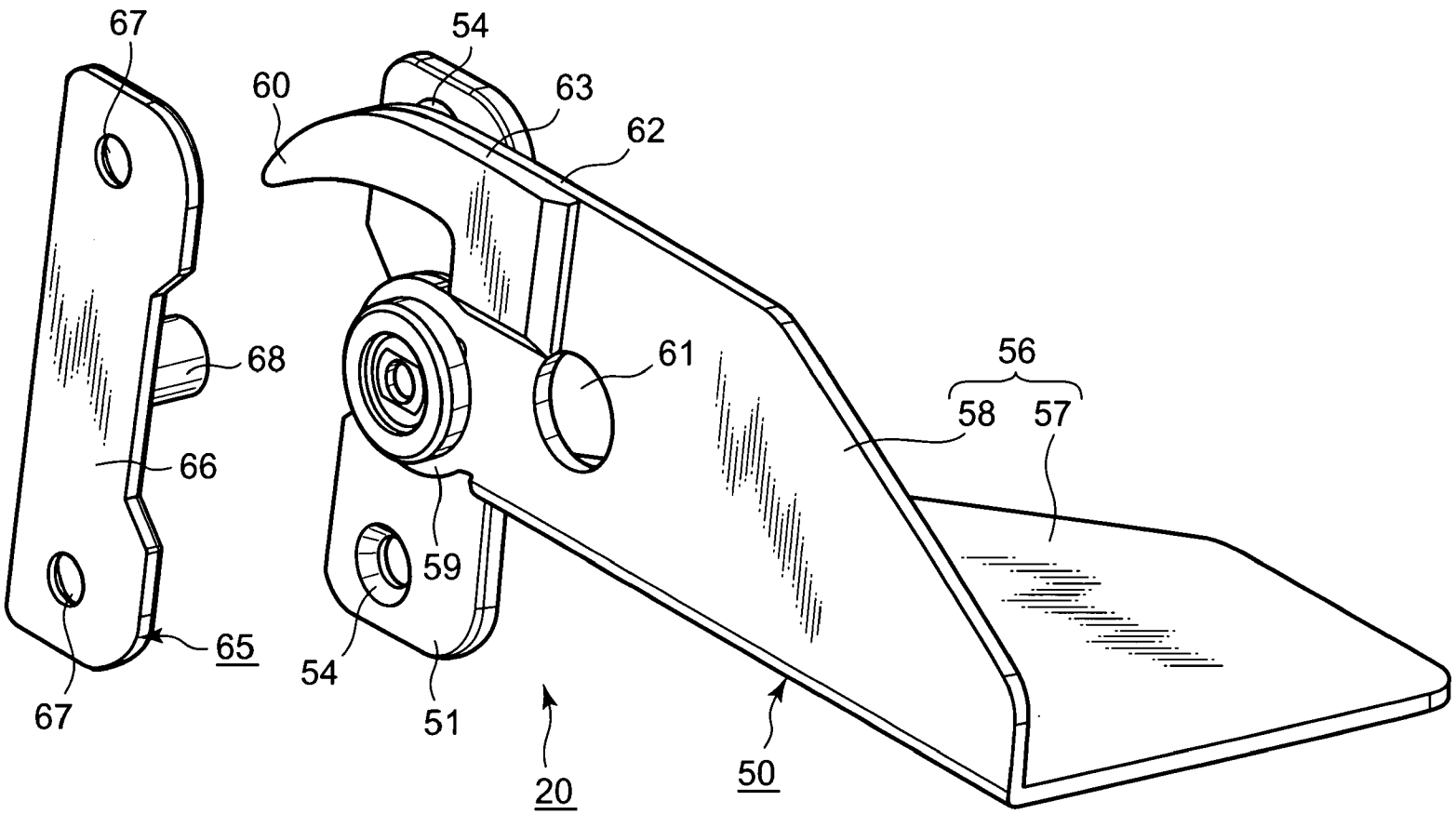
FIG. 9 is a perspective view showing an opened state of a latch device showing a second embodiment of the present invention.
Figure 10:
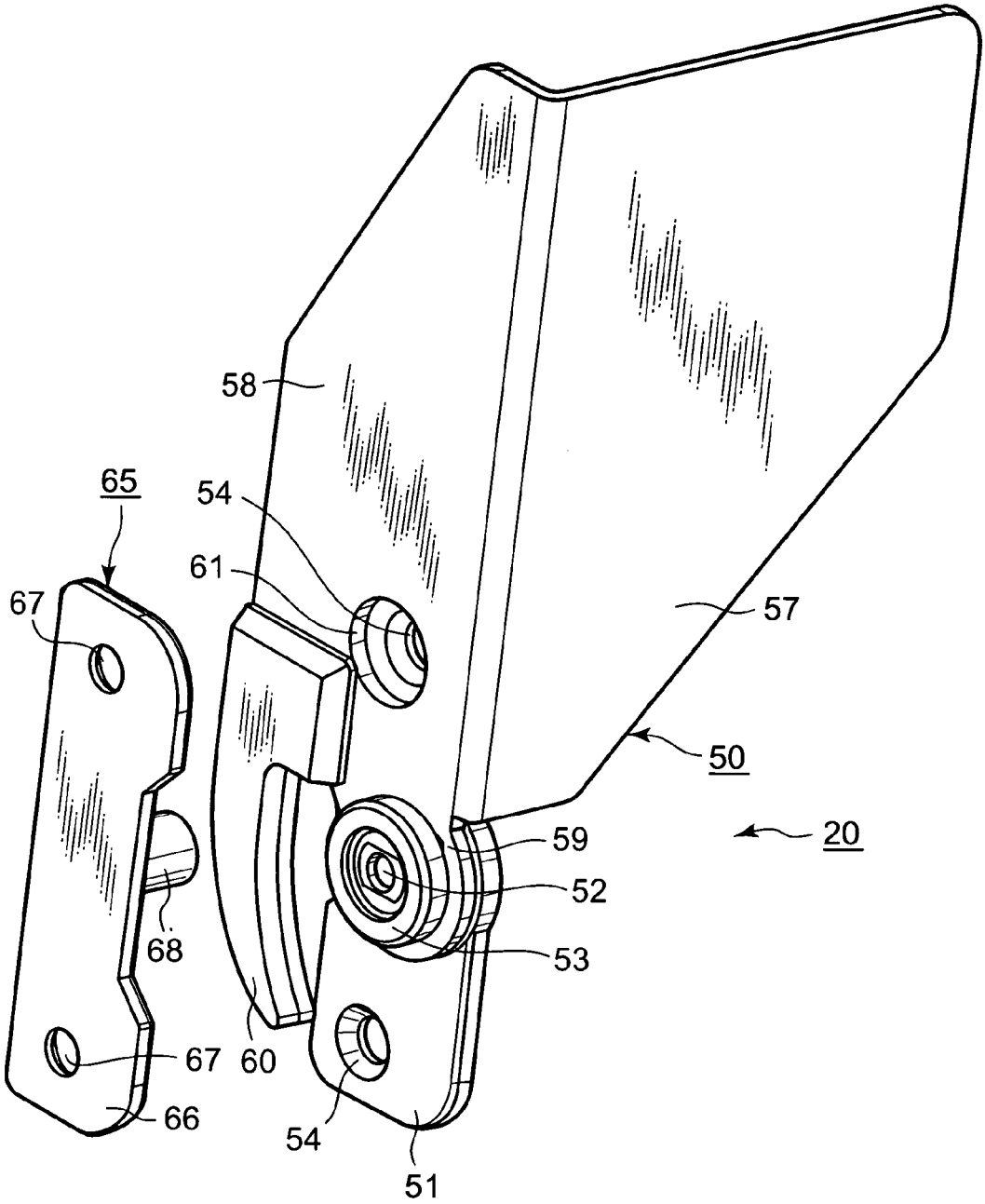
FIG. 10 is a perspective view of the latch device of the present invention in a closed state.
Figure 11:
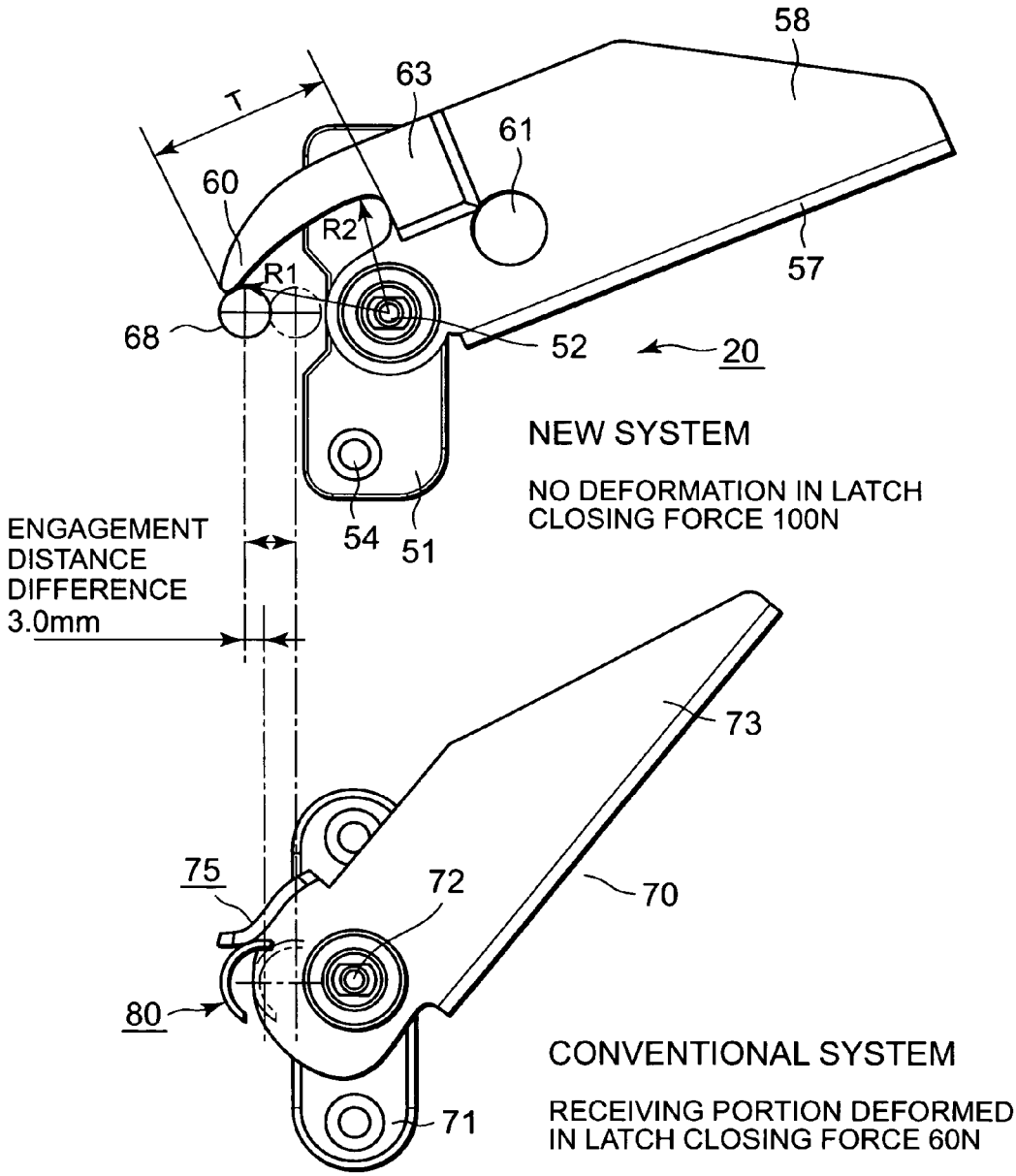
FIG. 11 is a side view showing comparison of a conventional latch deice with the latch device of the present invention.
Figure 12:
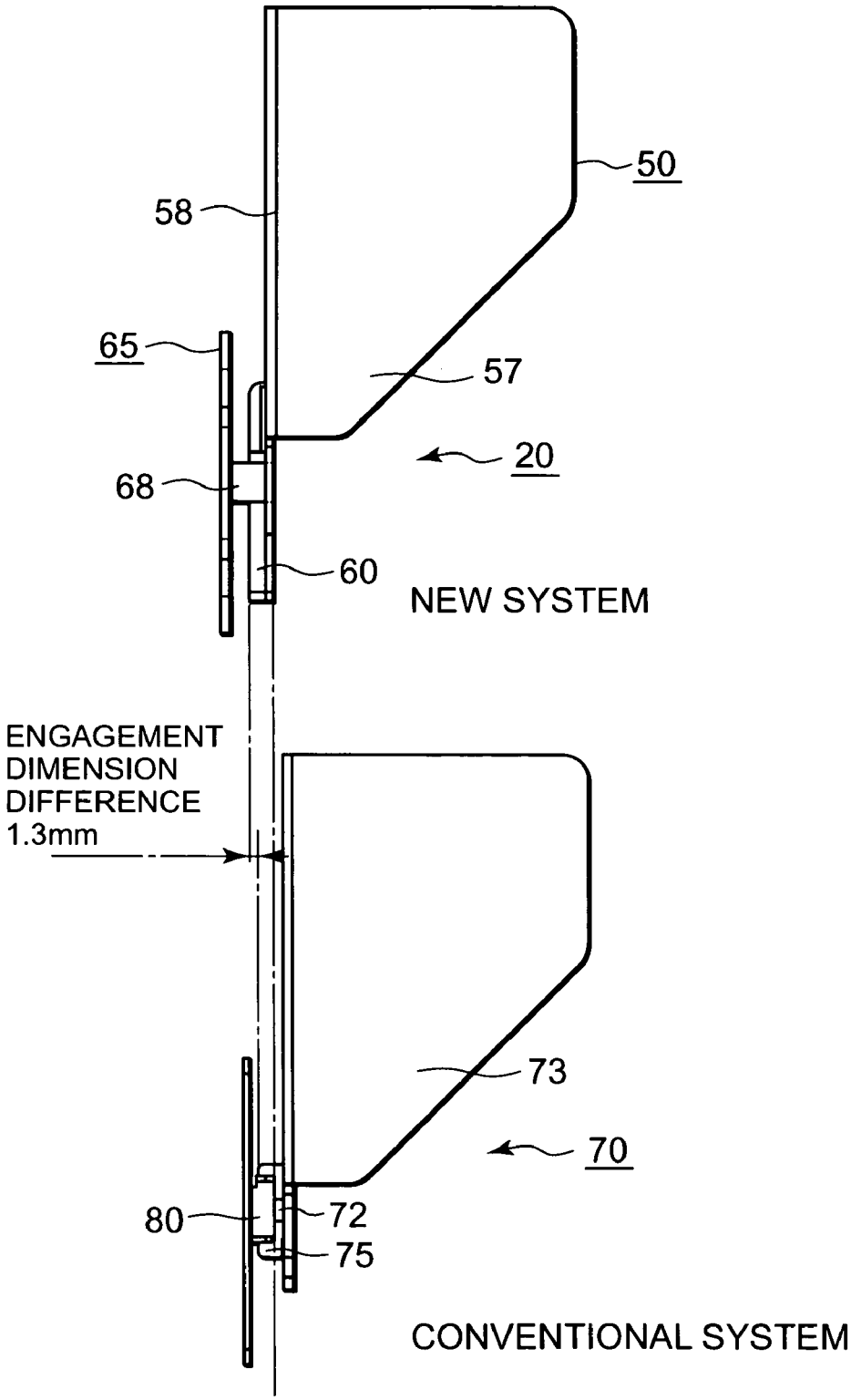
FIG. 12 is a front view showing comparison of a conventional latch device with the latch device of the present invention.

As shown in FIGS. 2 to 4, the storage chamber 5 is divided into a plurality of (four in the present embodiment) upper/lower sections by a plurality of (three in the present embodiment) shelves 11. Openings 12 corresponding to these sections (hereinafter referred to as small storage chambers) are also openably closed by thermal insulating inner doors. FIG. 2 shows an example in which the four small storage chambers are divided into two medium storage chambers constituted of two upper/lower small storage chambers, and medium openings 12 corresponding to the medium storage chambers are closed by two inner doors 13 which are first inner doors. FIG. 3 shows an example in which small openings 14 corresponding to four storage chambers are closed by four inner doors 15 that are second inner doors.

Any of the inner doors 13, 15 is provided with a latch device 20 constituted of: a shaft metal 65 disposed in each small opening 14 on a side on which any hinge is not attached and having a shaft portion 68 formed of a cast metal; and a metallic latch 50 rotatably and slidably disposed with respect to the inner door, and having a claw portion 60 engaging with the shaft portion 68 of the shaft metal 65.

Reference numeral 16 denotes a medium partition which divides the front-surface opening 2A into two upper/lower openings in a position corresponding to the shelf 11, and 17 denotes optional partition members which are partition members for further dividing the upper/lower medium openings 12 divided by the medium partition 16 into two upper/lower sections in positions corresponding to the shelves 11 to form four small openings 14. Reference numeral 18 denotes a door closing mechanism disposed corresponding to a grip 10 disposed on a non-shaft support side of the thermal insulating door 4.

Embodiment 1

An optional partition member 17 in a first embodiment of the present invention will be briefly described with reference to FIGS. 5 to 8.

First, the optional partition member 17 is constituted of: a main body 21 formed of a metal such as stainless steel; a resin frame member 31 attached to a front part of the main body 21 via screws 33 and the like; and a resin optional gasket 35 which is a gasket supported on the front surface of the frame member 31.

The main body 21 is constituted of: a pair of right/left support metals 22, 22 attached to attaching holes (not shown) formed in a side surface front part in an inner box of a thermal insulation box main body 2; and a beam member 23 suspended and supported by the opposite support metals 22, 22, having a groove portion 32 into which an arrow tip portion 37 of the optional gasket 35 is fitted, and having a U-shaped cross-sectional surface. The support metal 22 is symmetrically formed, and is constituted of: a laying portion 25 having a positioning hole 26 in its upper surface and having a U-shaped cross-sectional surface; and two fixing portions 27 continued from the laying portion 25, attached to the side surface front part in the inner box, and having attaching holes 28. Cutouts 29 are formed for ornamental small screws 30 in opposite ends of the beam member 23.

Additionally, an attaching operation of the main body 21 will be briefly described. The fixing portions 27 are fixed to attaching holes (not shown) formed in opposite side surfaces of the inner box via screws and the like to attach the support metals. The beam member 23 is laid on and supported by the laying portions 25 of the opposite support metals 22, 22 from above in such a manner as to fit opposite ends. Thereafter, the main body may be fastened and fixed by the ornamental small screws 30 in a state in which main body is horizontally positioned.

An optional gasket 35 comprises: a hollowed base portion 36 which abuts on a packing 48 disposed on the back surface peripheral edge portion of an inner door 15; the arrow tip portion 37 which is disposed in a back part of the base portion 36 and which is to be inserted into the groove portion 32 of the frame member 31; and upper/lower fin pieces 38, 39 which are disposed on upper and lower parts of the base portion 36 and which abut on the packing 48 above and below a portion abutting on the packing 48 of the inner door 15 to seal the packing.

The inner door 15 comprises: an outer plate 41; an inner plate 42; a door frame 43 which thermally insulates both the plates 41, 42 and which is formed of a resin; and a thermal insulating material 44 which is disposed in a space surrounded with the outer plate 41, the inner plate 42, and the door frame 43 and which is, for example, foam polystyrene, fibrous slab material or the like in consideration of insulation. As the thermal insulating material, a foam thermal insulating material may be charged into the space. The front part of the door frame 43 is attached to the outer plate 41, and the inner plate 42 is attached to the back part of the door frame. Therefore, when the openings 14 of the respective small storage chambers are closed, the front surfaces of the small storage chambers can be thermally insulated.

Additionally, the door frame 43 is provided with: a first groove 45 to which the packing 48 is attached; and a second groove 46 to which a finned packing 49 is attached. First sealing is performed by an abutment relation between the packing 48 and the optional gasket 35. Furthermore, the finned packing 49 extending inside the packing 48 disposed in the inner door 15 and toward the optional gasket 35 is capable of forming a space K surrounded with the packing 48, gasket 35, and finned packing 49, and second sealing is performed in an air layer in the space K to prevent permeation of outside air. That is, the first and second seals are capable of realizing a double seal, and thermal insulating performance is further enhanced.

When the optional partition member 17 in the first embodiment of the present invention is disposed to dispose the second inner door 15, the medium opening 12 can be further divided into the upper/lower small openings 14 by the metallic optional partition member 17. The optional gasket 35 can be supported by the resin frame member 31 attached to the front part of the main body 21 of the partition member 17. The respective small openings 14 newly divided by optional components like the partition member 17 can be openably closed by the second inner door 15, and a small-opening type low-temperature storage can be provided in accordance with user's demand.

When the first doors 13 are disposed without disposing any partition member 17, the storage can be provided in accordance with a medium-opening type inner door. As compared with the small-opening type, temperature distribution in the storage can be uniformed, and cooling performance is enhanced. That is, a temperature difference in the storage is 5.2° C. in the small-opening type, and enhanced at 3.6° C. in the medium-opening type. A controlled (reaching) temperature in the storage is −87.3° C. in the small-opening type, and is slightly enhanced at −87.9° C. in the medium-opening type. Additionally, since frontage is large, there is another advantage that a large object can be easily charged/discharged.

The support metals 22, 22 attached to the inner box side surface front part of the thermal insulation box main body, and the beam member 23 which is supported by the opposite support metals 22 and to which the frame member 31 for supporting the optional gasket 35 is attached and which has a U-shaped cross-sectional surface constitute the main body 21 of the optional partition member 17. Accordingly, strength of the partition member 17 is secured. On the other hand, height in a vertical direction can be suppressed, and an effective volume of the storage chamber 5 can be secured.

Since the beam member 23 of the optional partition member 17 is laid on and fixed to the support metal 22, the optional components can be easily and simply attached, and workability is enhanced.

The optional gasket 35 which abuts on the packing 48 disposed on the back surface peripheral edge portions of the upper/lower inner doors 15 absorbs shock at a time when the inner doors 15 are closed, and is capable of satisfactorily sealing the packing. The upper/lower fin pieces 38, 39 which abut on the packing 48 to seal the packing above and below the portion abutting on the packing 48 disposed on the optional gasket 35 more securely establish a contact relation between the gasket 35 and the packing 48, and are capable of enhancing sealability. Furthermore, the finned packing 49 extending inside the packing 48 disposed in the inner door 15 and toward the optional gasket 35 is capable of forming a space K defined by the packing 48, the gasket 35, and the finned packing 49. Permeation of outside air can be prevented by an air layer in the space K, and a sealing performance is remarkably enhanced.

The inner door 15 is constituted of: the outer plate 41; the inner plate 42; the door frame 43 which thermally insulates both the plates and which is formed of the resin; and the insulating material 44 disposed in the space surrounded with the outer plate, the inner plate, and the door frame, and therefore the openings 14 of the respective small storage chambers can be thermally insulated. Moreover, the door frame 43 is provided with: the first groove 45 to which the packing 48 is attached; and the second groove 46 to which the finned packing 49 is attached. Therefore, by the packing 48, optional gasket 35, and finned packing 49, double seal can be realized, and insulating performance of the inner door is further enhanced.

Embodiment 2

A latch device 20 in a second embodiment of the present invention will be described with reference to FIGS. 9 to 12.

The latch device 20 comprises: a metallic latch 50 rotatably disposed on a side (i.e., non-shaft support side) on which any hinge is not disposed in the side surface of an inner door 15, and having a claw portion 60 engaging with a shaft metal 65; and the stainless steel shaft metal 65 disposed in a portion of each small opening 14 on a side on which any hinge is not attached in an inner box of a thermal insulation box main body 2, and having a shaft portion 68 formed of a cast metal.

The latch 50 is constituted of: a fixed plate 51 which is attached to the side surface positioned on the non-shaft support side of the inner door 15 and which is formed of a metal such as stainless steel; and an operation member 56 which is rotatably supported by the fixed plate 51 and which is formed of a metal such as stainless steel. The fixed plate 51 has a supporting shaft 52, a protective ring 53 which protects the supporting shaft 52, and a fixing hole 54. The operation member 56 is constituted of: a handle 57; and an operation rod 58 having an arm portion 59 supported by the shaft 52. The operation rod 58 includes: a claw portion 60 which engages with a shaft metal 65 described later; and a window 61 formed in such a manner as to be brought into the same position as that of the fixing hole 54 of the fixed plate 51 at a use time of the latch 50 (i.e., a closing time of the inner door 15). The claw portion 60 has a double structure including a claw-shaped stainless layer 62 formed on the operation rod 58, and a cast metal layer 63 cast on the claw-shaped portion.

The shaft metal 65 comprises: an attaching portion 66 fixed on a side (i.e., a non-shaft support side) on which any hinge is not disposed in an inner box opening edge of the thermal insulation box main body 2, and having a fixing hole 67 and a shaft portion 68 formed of a cast metal into a columnar shape.

A latch operation of the latch device 20 will be briefly described. First, the inner door 15 is closed to a desired position. In the inner door in this state, the latch 50 is rotated forwards to a position where the latch forms an angle of about 70 degrees with the fixed plate 51. Moreover, the handle 57 is pushed and rotated backwards centering on the shaft 52 until the tip of the claw portion 60 contacts the shaft portion 68 of the shaft metal 65. The so-called latch operation of the inner door 15 is started from this state. That is, when the handle 57 is further pushed and rotated backwards along a curved surface formed on the inside of the claw portion 60, a rotating force is produced by a principle of leverage as if the surface of the shaft portion 68 moved the curved surface. The supporting shaft 52 of the latch device 20 approaches the shaft portion 68, and presses the inner door itself backwards (i.e., in the closing direction of the inner door 15), and the inner door 15 is firmly held in the closed state.

According to the latch device 20 in the second embodiment of the present invention, the shaft metal 65 is disposed in each small opening portion on the side on which any hinge is not attached in the inner box of the thermal insulation box main body, and has the shaft portion 68 formed of the cast metal. The metallic latch 50 is rotatably and slidably disposed on a plurality of inner doors 15 supported by the hinges to openably close each small opening divided by the optional partition member 17, and has the claw portion 60 which engages with the shaft metal 65. The rotating force is applied to the latch 50 in a state in which the claw portion 60 is engaged with the shaft portion 68 by the shaft metal and the latch. Then, a firm rotating force is produced by the principle of leverage by both the portions 60, 68, and the inner door 15 can be forcibly pushed backwards by this rotating force.

Moreover, the claw portion 60 is formed into the double structure of the stainless layer 62 and the cast metal layer 63. Accordingly, the strength of the latch 50 is enhanced, and a length and a distance in a thickness direction can be increased. Furthermore, since the shaft portion 68 is formed into the columnar shape, the strength is enhanced as compared with a plate-shaped cut raised portion 80. Moreover, the latch 50 is capable of changing the rotating force at a time when the claw portion 60 is engaged with the shaft portion 68 of the shaft metal 65 into a force for pushing the inner door 15 in the closing direction using the principle of leverage. Finally, a length T of the claw portion is set in such a manner that the inner door 15 is pushed in the closing direction by a dimensional difference between a rotation radius R1 of the tip of the abutment surface of the claw portion 60 with respect to the shaft portion 68, and a rotation radius R2 of the terminal end. Therefore, a rotary momentum of the latch 50 with respect to the shaft portion 68 can be increased, it is possible to bring the latch 50 into a latched state even with a smaller force, and the usability of a latch device is enhanced.

What is claimed is:

1. A low-temperature storage comprising:

a thermal insulation box main body having an opening in a front surface thereof;

a thermal insulating door openably/closably attached to the thermal insulation box main body;

a medium partition which divides the opening into upper/lower medium openings;

a shelf which divides a storage chamber formed by the thermal insulating door and the main body into upper/lower chambers in a position of the medium partition; and a cooling device which cools the storage chamber, the low-temperature storage further comprising:

a metallic partition member which further divides the medium openings into upper/lower openings;

a frame member formed of a resin and attached to a front part of the partition member to support gasket; and a plurality of inner doors which openably close small openings divided by the partition member, the inner doors provided with a packing disposed on back surface peripheral edge portions, with the gasket abutting directly against the packing.

2. The low-temperature storage according to claim 1, wherein the partition member comprises:

support metals attached to an inner box side surface front portion of the thermal insulation box main body; and a beam member which is supported by the opposite support metals and to which the frame member is attached and whose cross-sectional surface has a U-shape.

3. The low-temperature storage according to claim 2, wherein the beam member is laid on and fixed to the support metals.

4. The low-temperature storage according to claim 1, wherein the gasket comprises:

upper/lower fin pieces which seal the packing above and below a portion abutting on the packing.

5. The low-temperature storage according to claim 1, wherein the inner door comprises:

a finned packing extending inside the packing and toward the gasket.

6. A low-temperature storage comprising:

a thermal insulation box main body having an opening in a front surface thereof:

a thermal insulating door openably/closably attached to the thermal insulation box main body;

a medium partition which divides the opening into upper/lower medium openings;

a shelf which divides a storage chamber formed by the thermal insulating door and the main body into upper/lower chambers in a position of the medium partition; and a cooling device which cools the storage chamber, the low-temperature storage further comprising:

a metallic partition member which further divides the medium openings into upper/lower openings:

a frame member formed of a resin and attached to a front part of the partition member to support an optional gasket; and a plurality of inner doors which openably close small openings divided by the partition member, wherein the gasket abuts on a packing disposed on back surface peripheral edge portions of the upper/lower inner doors, the inner door comprising a finned packing extending inside the packing and toward the optional gasket, wherein the inner door comprises:

an outer plate;

an inner plate;

a door frame which thermally insulates both the plates and which is formed of a resin; and an insulating material disposed in a space surrounded with the outer plate, the inner plate, and the door frame, and the door frame is provided with:

a first groove to which the packing is attached; and a second groove to which the finned packing is attached.

7. A low-temperature storage comprising:

a thermal insulation box main body having an opening in a front surface thereof;

a thermal insulating door openably/closably attached to the thermal insulation box main body; a medium partition which divides the opening into upper/lower medium openings;

a shelf which divides a storage chamber formed by the thermal insulating door and the main body into upper/lower chambers in a position of the medium partition;

a cooling device which cools the storage chamber around −80° C.; and a partition member which is formed of a metal and which further divides the medium openings into upper/lower openings and to whose front portion a frame member formed of a resin and supporting a gasket is attached, the low-temperature storage further comprising:

a plurality of inner doors which are supported by hinges and which openably close small openings divided by the partition member;

a shaft metal, situate within the box main body;

disposed in portions of the respective small openings on a side on which any hinge is not attached in an inner box of the thermal insulation box main body, and having a shaft portion formed of a cast metal; and a metallic latch rotatably disposed on the inner door and having a claw portion, with a curved surface formed on the inside thereof, engaging with the shaft metal.

8. The low-temperature storage according to claim 7, wherein the claw portion has a double structure of a stainless layer and a cast metal layer.

9. The low-temperature storage according to claim 7, wherein the shaft portion is formed into a columnar shape, and the latch pushes the inner door in a closing direction with the rotating force at a time when the claw portion is engaged with the shaft portion.

10. A low-temperature storage comprising:

a thermal insulation box main body having an opening in a front surface thereof:

a thermal insulating door openably/closably attached to the thermal insulation box main body;

a medium partition which divides the opening into upper/lower medium openings;

a shelf which divides a storage chamber formed by the thermal insulating door and the main body into upper/lower chambers in a position of the medium partition;

a cooling device which cools the storage chamber around −80° C.; and a partition member which is formed of a metal and which further divides the medium openings into upper/lower openings and to whose front portion a frame member formed of a resin and supporting a gasket is attached, the low-temperature storage further comprising:

a plurality of inner doors which are supported by hinges and which openably close small openings divided by the partition member;

a shaft metal disposed in portions of the respective small openings on a side on which any hinge is not attached in an inner box of the thermal insulation box main body, and having a shaft portion formed of a cast metal; and a metallic latch rotatably disposed on the inner door and having a claw portion engaging with the shaft metal, wherein the shaft portion is formed into a columnar shape, and the latch pushes the inner door in a closing direction with the rotating force at a time when the claw portion is engaged with the shaft portion, and wherein a length of the claw portion is set in such a manner that the inner door is pushed in the closing direction by a dimensional difference between a rotation radius of a tip of an abutment surface of the claw portion with respect to the shaft portion, and a rotation radius of a terminal end.

11. A low-temperature storage comprising:

a thermal insulation box main body having an opening in a front surface thereof;

a single thermal insulating door openably/closably attached to the thermal insulation box main body;

a single medium partition which divides the opening into upper/lower medium openings; a shelf which divides a storage chamber formed by the-thermal insulating door and the main body into upper/lower chambers in a position of the medium partition; and a cooling device which cools the storage chamber around −80° C., the low-temperature storage further comprising:

two first inner doors which openably close the upper/lower medium openings in a case where a partition member detachably attached to further divide the medium openings into upper/lower small openings is not disposed; or four second inner doors which openably close the four small openings in a case where the partition member is disposed; and a resin-formed frame member which is attached to the front portion of the partition member to support a gasket the gasket directly abutting on a packing disposed on back surface peripheral edge portions of the second inner doors, and having upper/lower fin pieces to seal the packing above and below a portion which directly abuts on the packing.

12. The low-temperature storage according to claim 11, wherein the second inner door comprises: a finned packing extending inside the packing and toward the gasket.

* * * * *